US005690419A

United States Patent [19]

Siems

[11] Patent Number: 5,690,419

[45] Date of Patent: Nov. 25, 1997

[54] OPTICAL REFLECTOR MOUNTING ASSEMBLY

[76] Inventor: Steven L. Siems, 1491 SW. 21st Ave., Fort Lauderdale, Fla. 33314

[21] Appl. No.: 621,907

[22] Filed: Mar. 26, 1996

[51] Int. Cl.[6] ..... F21V 21/26

[52] U.S. Cl. ..... 362/269; 362/285; 362/294; 362/427

[58] Field of Search ..... 362/371, 373, 362/427, 269, 285, 294; 439/6, 10, 165

[56] References Cited

U.S. PATENT DOCUMENTS

| | | | |
|---|---|---|---|
| 2,587,917 | 3/1952 | Stone | 362/371 |
| 3,254,205 | 5/1966 | Cobb | 362/285 |
| 4,190,881 | 2/1980 | Drost et al. | 362/250 |
| 4,228,489 | 10/1980 | Martin | 362/250 |
| 4,523,263 | 6/1985 | Poyer | 362/267 |
| 4,894,759 | 1/1990 | Siems | 362/250 |
| 5,154,507 | 10/1992 | Collins | 362/218 |
| 5,386,356 | 1/1995 | Davis, Jr. et al. | 362/267 |
| 5,450,303 | 9/1995 | Markiewicz et al. | 362/427 |
| 5,481,441 | 1/1996 | Stevens | 362/35 |

*Primary Examiner*—Carroll B. Dority
*Attorney, Agent, or Firm*—Oltman, Flynn & Kubler

[57] ABSTRACT

An optical reflector mounting assembly includes a base with a gasket for sealingly mounting the base on a cross-arm of a unitary support assembly for flood lights. There is a light socket for receiving a flood lamp, and a mounting socket for holding the light socket and for dissipating heat generated by the light socket in operation. There are fins on the outside of the mounting socket for dissipating heat, and a device for pivotally mounting the mounting socket on the base for pivotal movement of the mounting socket and the light socket relative to the base.

10 Claims, 3 Drawing Sheets

FIG. 7
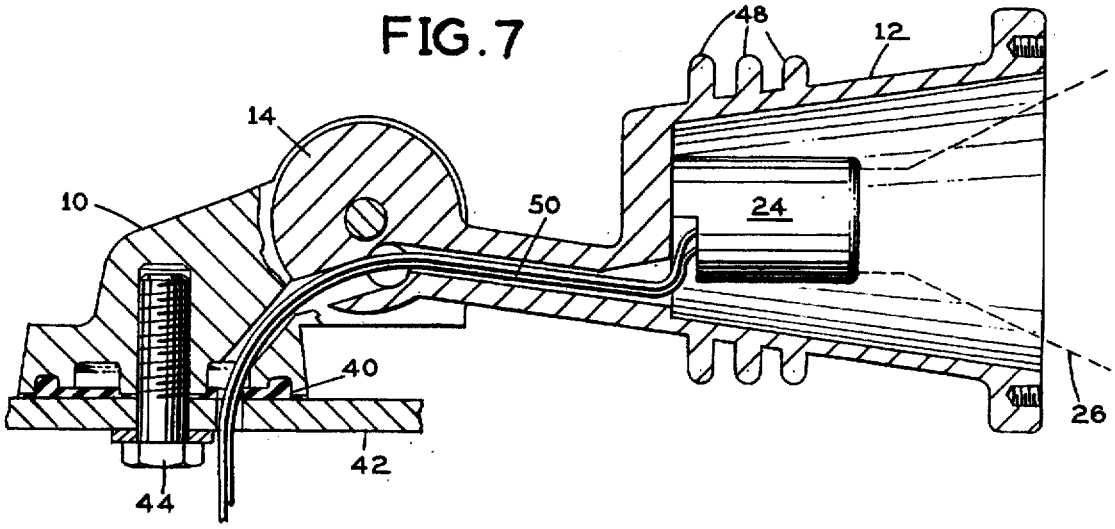
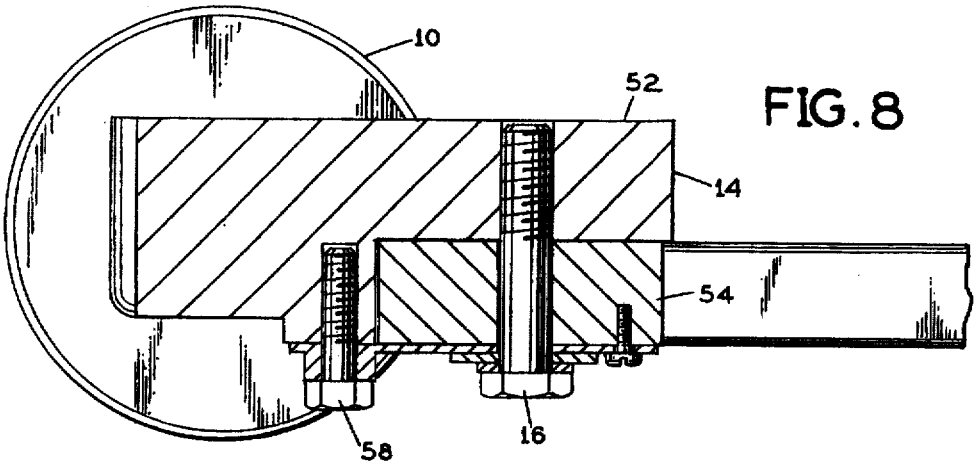
FIG. 8
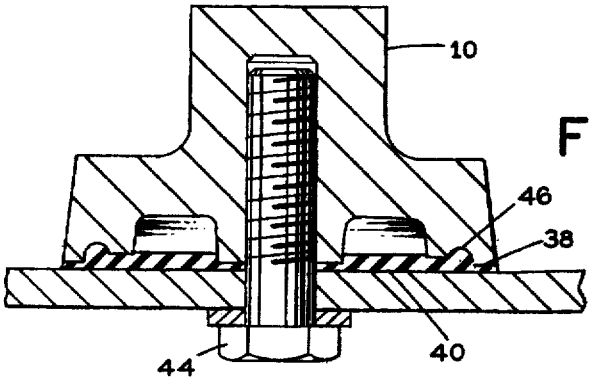
FIG. 9

OPTICAL REFLECTOR MOUNTING ASSEMBLY

FIELD OF THE INVENTION

This invention relates to optical reflector mounting assemblies, and in particular to an optical reflector mounting assembly of a type which is particularly useful in connection with pre-wired unitary support assemblies for floodlights.

BACKGROUND OF THE INVENTION

Pre-wired unitary support assemblies for mounting floodlights on a pole are well known. A particular example is described and claimed in U.S. Pat. No. 4,894,759 dated Jan. 16, 1990 and owned by the present inventor. The floodlight assemblies shown in that patent were of a known design with a parabolic reflector and a lens assembly attached to a housing for wiring and ballast. It has been found that it would be desirable to have a more universal type of mounting which would allow floodlight reflectors and floodlights of different types to be used. Also, excessive heat has been a problem and sometimes leakage of water can be a problem as well.

SUMMARY OF THE INVENTION

The invention provides an optical reflector mounting assembly which includes a base, the base having a bottom surface with a gasket for sealingly mounting the base on a cross-arm, a light socket for receiving a flood lamp, a mounting socket for holding the light socket, fins on the outside of the mounting socket for dissipating heat, and a knuckle joint for pivotally mounting the mounting socket on the base for pivotal movement of the mounting socket and the light socket together relative to the base. This type of reflector assembly is adapted to have a fastening means on the face of the mounting socket which will receive several different types of reflectors and flood lamps to make the reflector assembly universal. There are gaskets for preventing water from leaking into the base, possibly causing damage.

Accordingly, it is an object of the invention to provide an optical reflector and mounting assembly of a universal construction.

Another object of the invention is to reduce leakage of water in an optical reflector and mounting assembly.

A further object of the invention is to dissipate heat from a light socket provided in an optical reflector mounting assembly.

Further objects and advantages of this invention will be apparent from the following detailed description of a presently preferred embodiment which is illustrated schematically in the accompanying drawings.

BRIEF DESCRIPTION OF THE DRAWINGS

FIG. 7 is a sectional view taken along line 7—7 of FIG. 3;

FIG. 8 is a sectional view taken along line 8—8 of FIG. 5; and

FIG. 9 is a sectional view taken along line 9—9 of FIG. 3;

Before explaining the disclosed embodiment of the present invention in detail it is to be understood that the invention is not limited in its application to the details of the particular arrangement shown since the invention is capable of other embodiments. Also, the terminology used herein is for the purpose of description and not of limitation.

DETAILED DESCRIPTION OF THE PREFERRED EMBODIMENT

Figure 1:
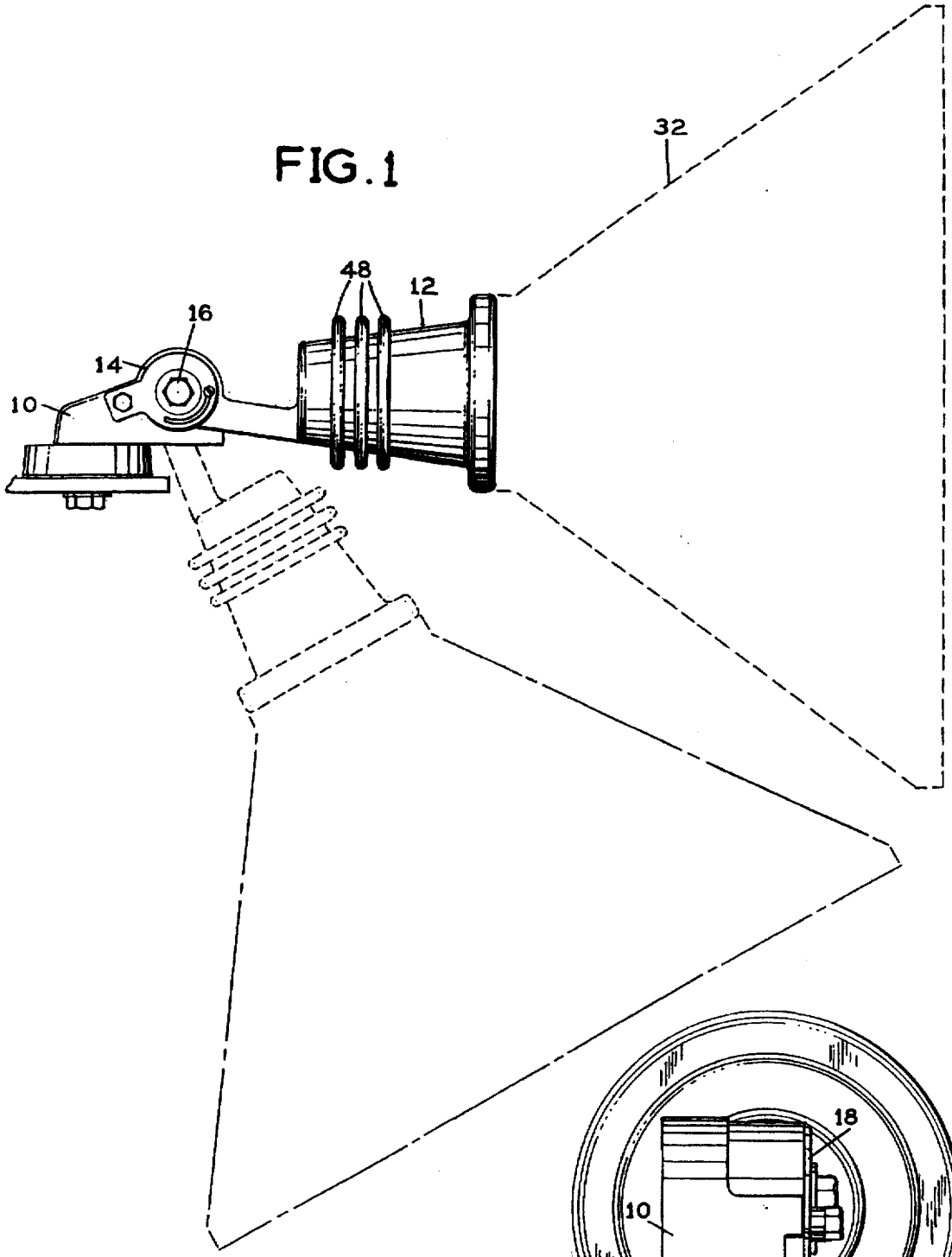
FIG. 1 is a side elevational view of an optical reflector mounting assembly in accordance with the invention and provided with a reflector shown in dashed lines and shown in changed positions.
Figure 2:
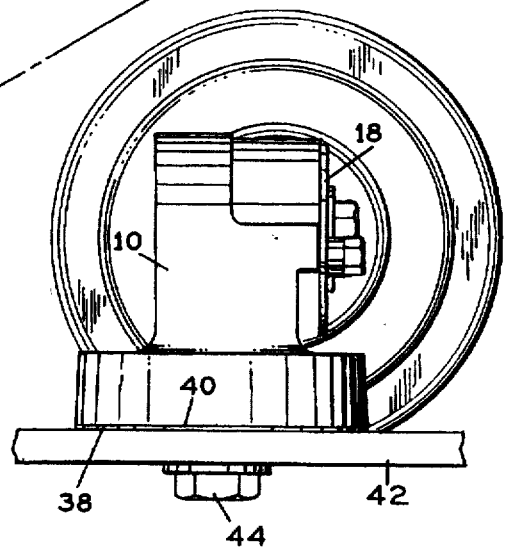
FIG. 2 is an end view thereof.
Figure 4:
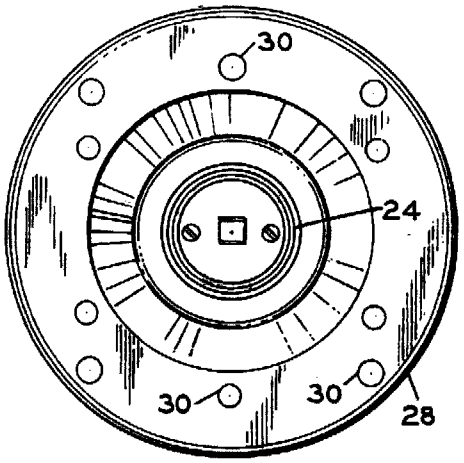
FIG. 4 is a view taken along line 4—4 of FIG. 3 showing the mouth of the mounting socket.
Figure 3:
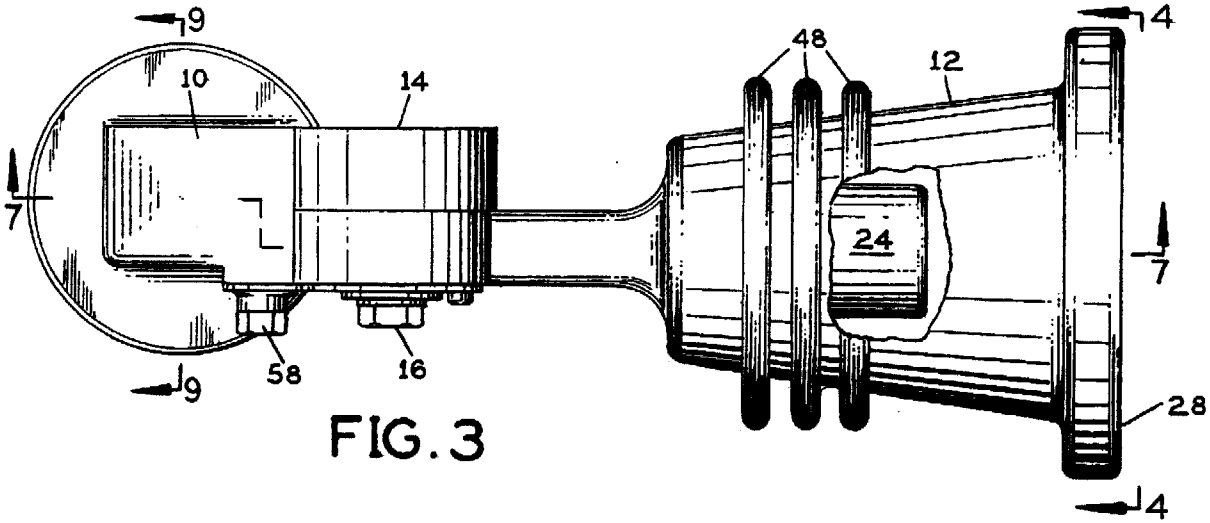
FIG. 3 is a top plan view of the optical reflector mounting assembly of FIG. 1 with a portion of the mounting socket broken away to reveal the light socket.
Figure 5:
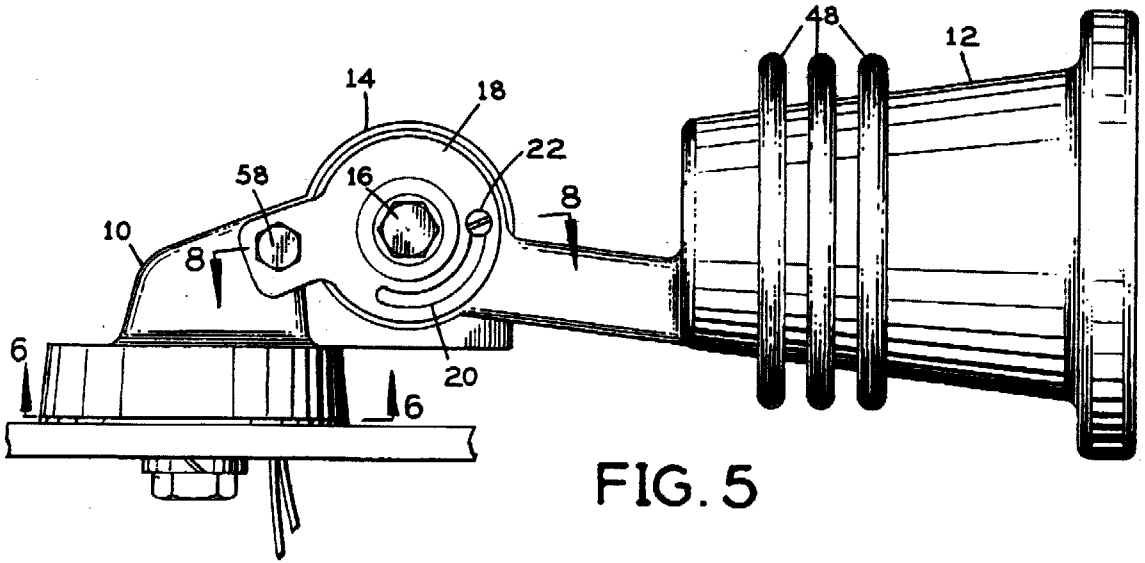
FIG. 5 is an enlarged side elevational view of the optical reflector mounting assembly.

The optical reflector mounting assembly of FIGS. 1, 2 and 3 includes a base 10 adapted to be sealingly mounted on a a cross-arm of the pre-wired unitary support assembly of U.S. Pat. No. 4,894,759 referred to above. The assembly also includes a mounting socket 12 which is pivotally attached to the base 10 by a knuckle joint 14 which includes a bolt 16. Attached to one face of the knuckle joint is a plate 18 (FIG. 5) which has a circular cut-out slot 20 that receives the head of screw 22. The screw abuts against the opposite ends of the slot 20 in different positions of the mounting socket 12 shown in FIG. 1 at the limits of pivotal movement of the mounting socket.

Inside the mounting socket 12 there is mounted a light socket 24 for receiving a flood lamp 26 shown in dotted lines in FIG. 7. The mounting socket 12 is conical and has a mouth 28 with bolt holes 30 in it at various positions designed to accept reflectors, such as reflector 32 in FIG. 1, of different types and sizes. This makes the optical reflector mounting assembly universal.

Figure 6:
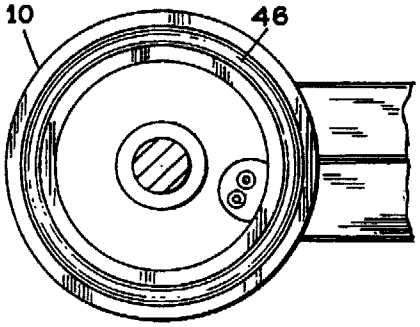
FIG. 6 is a sectional view taken along line 6—6 of FIG. 5.

As shown in FIGS. 2, 6 and 9, the base 10 has a bottom surface 38 which receives a gasket 40 that is held tightly against the cross-arm 42 of the pre-wired unitary support assembly for flood lights by a bolt 44 that screws through a portion the cross-arm into the base 10 as shown in FIG. 9. The bottom surface 38 of the base 10 has a circular groove 46 into such the gasket 40 is compressed making a good seal for keeping water from leaking into the base and interfering with the wiring.

The light socket 24 gets relatively hot during operation of the flood lamp so the outside of the mounting socket 12 is provided with circular fins 48 which dissipate the heat and help keep the light socket cooler.

The wiring 50 extends from the light socket through the knuckle joint 14 and through the base 10 into the cross-arm 42.

The knuckle joint 14 is shown in FIG. 8. The base 10 has an arm 52, and the mounting socket 12 has an arm 54 butting against the arm 52 and these two arms are pivotally held together by a bolt 16. The bolt 58 holds the plate 18 on the face of the arm 54. An O-ring (not shown) may be provided inside the knuckle joint. The captive bolt 58 is designed in such a way that when it is backed out of the clearance hole in base 10 and the through bolt 16 is loosened, the mounting socket 12 can be rotated up for relamping. After relamping is completed the assembly can be repositioned by bolt 58 to the same vertical aiming position.

The unique design of base 10 allows the gasket 40 that is weather sealed to the crossarm assembly to provide the following benefits: completely encloses the gasket so that there is no degradation due to ultraviolet radiation from the environment, provides metal to metal contact to assure positive horizontal alignment and provides electrical continuity for grounding purposes.

I claim:

1. An optical reflector mounting assembly for mounting a reflector and a flood lamp on a crossarm, comprising:

a base;

means for sealingly mounting said base on said cross-arm;

a light socket for receiving a flood lamp;

a mounting socket for holding said light socket;

means on the outside of said mounting socket for dissipating heat;

and means for pivotally mounting said mounting socket on said base for pivotal movement of said mounting socket and said light socket relative to said base, said mounting socket having means for mounting reflectors of different types, and said means for mounting reflectors comprising bolts.

2. The optical reflector assembly of claim 1 in which said heat dissipating means comprises cooling fins.

3. The optical reflector assembly of claim 2 in which said mounting socket is circular and said cooling fins encircle said mounting socket.

4. The optical reflector assembly of claim 3 in which said light socket is mounted inside said mounting socket.

5. The optical reflector assembly of claim 4 in which said mounting socket is conical.

6. The optical reflector assembly of claim 5 in which said base has a bottom surface receiving a gasket for sealing said surface to said cross-arm.

7. The optical reflector mounting assembly of claim 6 in which the mounting socket has a mouth for receiving said reflector around said flood lamp.

8. The optical reflector mounting assembly of claim 7 in which said means for pivotally mounting said mounting socket comprises a knuckle joint and a bolt through said knuckle joint.

9. The optical reflector mounting assembly of claim 8 in which said bottom surface of said base includes a groove for receiving said gasket.

10. An optical reflector mounting assembly for mounting a reflector and a flood lamp on a crossarm, comprising:

a base;

means for sealingly mounting said base on said cross-arm;

a light socket for receiving a flood lamp;

a mounting socket for holding said light socket;

means on the outside of said mounting socket for dissipating heat;

and means for pivotally mounting said mounting socket on said base for pivotal movement of said mounting socket and said light socket relative to said base, said means for pivotally mounting said mounting socket on said base including a knuckle joint and a plate having a slot therein and a stop in said slot for limiting the pivotal movement of said mounting socket.

* * * * *